US011485608B2

(12) United States Patent
Tegtmeier et al.

(10) Patent No.: US 11,485,608 B2
(45) Date of Patent: Nov. 1, 2022

(54) ELEVATOR SAFETY SYSTEM

(71) Applicants: Otis Elevator Company, Farmington, CT (US); Dirk H. Tegtmeier, Berlin (DE)

(72) Inventors: Dirk H. Tegtmeier, Berlin (DE); Peter Herkel, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 1080 days.

(21) Appl. No.: 16/085,710

(22) PCT Filed: Mar. 18, 2016

(86) PCT No.: PCT/EP2016/056024
§ 371 (c)(1),
(2) Date: Sep. 17, 2018

(87) PCT Pub. No.: WO2017/157469
PCT Pub. Date: Sep. 21, 2017

(65) Prior Publication Data

US 2019/0092601 A1 Mar. 28, 2019

(51) Int. Cl.
*B66B 5/00* (2006.01)
*B66B 1/24* (2006.01)

(52) U.S. Cl.
CPC ..... *B66B 5/005* (2013.01); *B66B 1/24* (2013.01)

(58) Field of Classification Search
CPC ..... B66B 5/00; B66B 5/02
See application file for complete search history.

(56) References Cited

U.S. PATENT DOCUMENTS 5,025,895 A 6/1991 Leone et al.
6,050,369 A 4/2000 Leone et al.
6,550,585 B2 4/2003 Schoppa et al.
(Continued)

FOREIGN PATENT DOCUMENTS

CN 1478716 A 3/2004
CN 101723218 A 6/2010
(Continued)

OTHER PUBLICATIONS

International Search Report and Written Opinion for application PCT/EP2016/056024, dated Dec. 21, 2016, 10 pages.
(Continued)

*Primary Examiner* — Daniel Abebe
(74) *Attorney, Agent, or Firm* — Cantor Colburn LLP

(57) ABSTRACT

An elevator safety system includes: at least two sensors, each of the sensors being configured for monitoring at least a portion of a hoistway of an elevator system and providing monitoring signals; a transformation unit which is configured for transforming the monitoring signals provided by at least one of the sensors and producing transformed signals corresponding to a common direction of vision; a comparison unit which is configured for comparing the at least two transformed signals and for generating a failure signal if a difference between the at least two transformed signals exceeds a predetermined threshold; and a detection unit, which is configured for detecting a person or undesired item in at least one of the two transformed signals and for generating an alarm signal if a person or undesired item is detected.

15 Claims, 3 Drawing Sheets

(56) References Cited

U.S. PATENT DOCUMENTS

| | | | | |
|---|---|---|---|---|
| 6,863,161 | B2 | 3/2005 | Mearns et al. | |
| 7,201,256 | B2 | 4/2007 | Deplazes et al. | |
| 7,448,473 | B2 | 11/2008 | Lindberg et al. | |
| 7,954,606 | B2 | 6/2011 | Tinone et al. | |
| 8,061,486 | B2 | 11/2011 | Monzon et al. | |
| 8,334,906 | B2 | 12/2012 | Lipton et al. | |
| 8,540,057 | B2 | 9/2013 | Schuster et al. | |
| 8,556,043 | B2 | 10/2013 | Mangini et al. | |
| 11,339,026 | B2 * | 5/2022 | Hu | B66B 1/34 |
| 2004/0020725 | A1 | 2/2004 | Utsunomiya et al. | |
| 2010/0308762 | A1 * | 12/2010 | Kallioniemi | B66B 5/06 318/450 |
| 2012/0018256 | A1 | 1/2012 | Mangini et al. | |
| 2013/0118836 | A1 | 5/2013 | Rossignol | |
| 2018/0162693 | A1 * | 6/2018 | Hu | B66B 7/048 |
| 2019/0248625 | A1 * | 8/2019 | Mustonen | B66B 5/0037 |

FOREIGN PATENT DOCUMENTS

| | | | |
|---|---|---|---|
| CN | 101883730 | A | 11/2010 |
| EP | 2080725 | A1 | 7/2009 |
| KR | 20140039404 | A | 4/2014 |
| WO | 2009051587 | A1 | 4/2009 |

OTHER PUBLICATIONS

Li He, et al., "Human detection using mobile embedded smart cameras", Abstract, 2011 Fifth ACM/IEEE International Conference on Distributed Smart Cameras, 3 pages.

Security News Desk, "From Passive to Active Video Surveillance—With the Intelligent Cameras from RIVA", available at: http://www.securitynewsdesk.com/from-passive-to-active-video-surveillance-with-the-intelligent-cameras-from-riva-2/, Jul. 24, 2014, 6 pages.

Chinese First Office Action for application 201680083728.2, dated Jun. 27, 2019, 5 pages.

* cited by examiner

ELEVATOR SAFETY SYSTEM

The present application relates to an elevator safety system and to an elevator system comprising such an elevator safety system. The application further relates to a method of operating an elevator system.

In elevator systems, in particular in modern elevator installations provided with a low pit at the bottom of the hoistway and/or a low overhead at the top of the hoistway, it is essential to reliably detect people which are present in the hoistway, e.g. for repair or maintenance, in order to avoid that said people are hit or squeezed by a moving elevator car.

It therefore is desirable to provide an elevator safety system which is easy to install and which is capable to reliably detect the presence of people in the hoistway.

According to an exemplary embodiment of the invention, an elevator safety system comprises at least two sensors, wherein each of the sensors is configured for monitoring at least a portion of the hoistway of an elevator system and for providing monitoring signals; a transformation unit which is configured for transforming the monitoring signals provided by at least one of the sensors and producing transformed signals corresponding to a common direction of vision; a comparison unit which is configured for comparing the at least two transformed signals and for generating a failure signal if the difference between the at least two transformed signals exceeds a predetermined threshold; and a detection unit, which is configured for detecting a person or an undesired item in at least one of the two transformed signals and for generating an alarm signal if such a person or item is detected.

Exemplary embodiments further include an elevator system comprising such an elevator safety system and a method of operating an elevator system comprising the steps of monitoring at least a portion of the hoistway with at least two sensors and providing monitoring signals; transforming the monitoring signals provided by the at least two sensors to correspond to the same direction of vision; comparing the at least two transformed signals and generating a failure signal if a difference between the at least two transformed signals is detected; checking at least one of the two transformed signals for persons or undesired items and generating an alarm signal if at least one person or undesired item is detected. In case a failure signal and/or an alarm signal is generated, the operation of the elevator system is stopped.

By employing at least two sensors the presence of a person or undesired item in the hoistway is reliably detected. By comparing the signal provided by the at least two sensors, the sensors supervise each other and a malfunction of one of the sensors is reliably detected. This prevents the elevator system from being operated under unsafe conditions in which at least one of the sensors does not operate properly. As a result, the safety of the elevator system is considerably enhanced and persons and items being present in the hoistway are prevented from being hit or squeezed by a moving elevator car.

An exemplary embodiment of the invention is described in the following with reference to the enclosed figures.

FIG. 1 schematically depicts an elevator system comprising an elevator safety system according to an exemplary embodiment of the invention.

Figure 1:
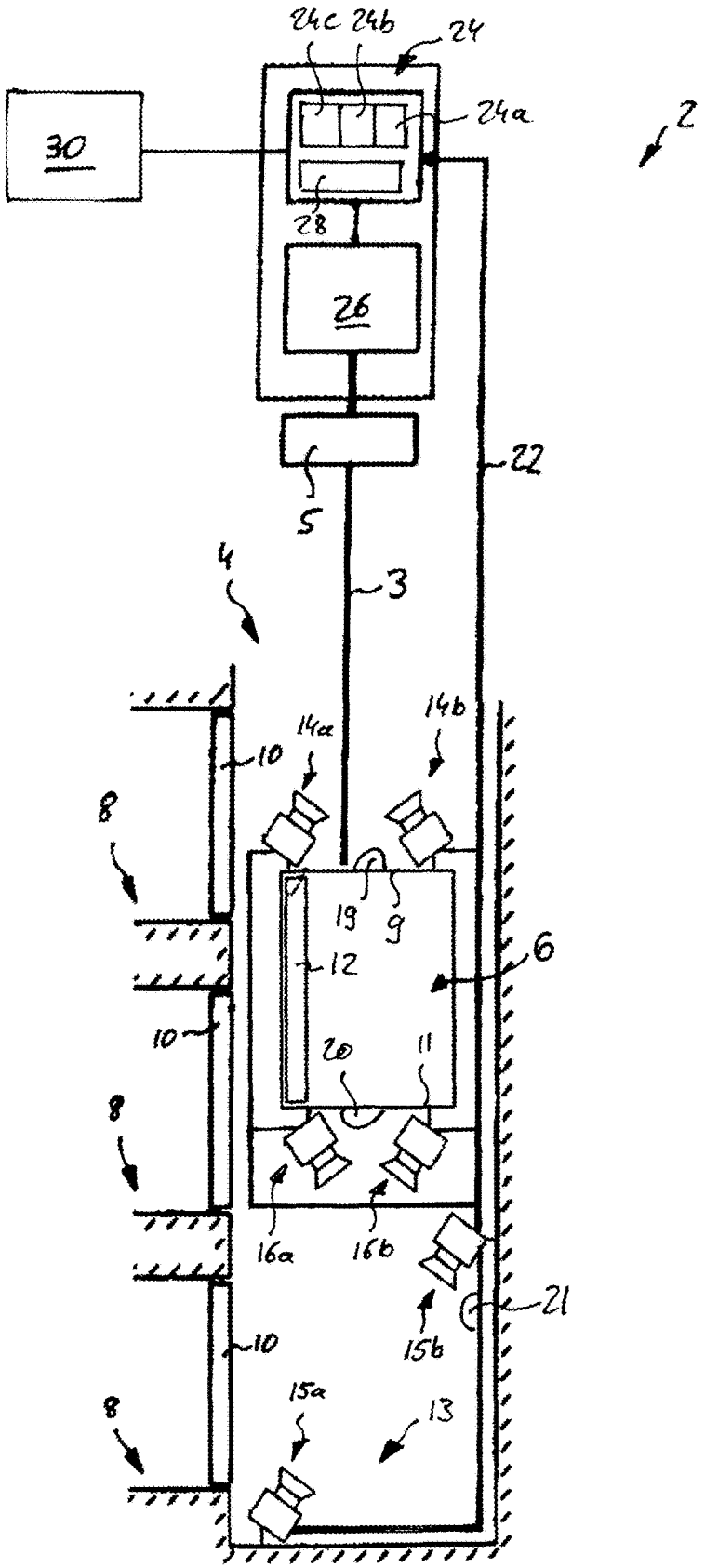
FIG. 1 depicts an elevator system 2 comprising an elevator access control system according to an exemplary embodiment of the invention.

The elevator system 2 includes an elevator car 6 which is movably suspended within a hoistway 4 by means of a tension member 3. The tension member 3, for example a rope or belt, is connected to an elevator drive 5, which is configured for driving the tension member 3 in order to move the elevator car 6 along the height of the hoistway 4 between a plurality of different landings 8.

Each landing 8 is provided with a landing door 10, and the elevator car 6 is provided with a corresponding elevator car door 12 allowing persons to transfer between the landing 8 and the interior of the elevator car 6 when the elevator car 6 is positioned at the respective landing 8.

The exemplary embodiment shown in FIG. 1 uses a 1:1 roping for suspending the elevator car 6. The skilled person, however, easily understands that the type of the roping is not essential for the invention and different kinds of roping, e.g. a 2:1 roping, may be used as well. The elevator system 2 may use a counterweight (not shown) or not. The elevator drive 5 may be any form of drive used in the art, e.g. a traction drive or a hydraulic drive.

The elevator drive 5 is controlled by an elevator control unit 26 for moving the elevator car 6 between the different landings 8.

The elevator car 6 is provided with a first sensor pair comprising two sensors 14*a*, 14*b* mounted to the top (roof) 9 of the elevator car 6 and which are configured for monitoring an area of the hoistway 4 above the elevator car 6.

Additionally or alternatively the elevator car 6 may be provided with a second sensor pair comprising two sensors 16*a*, 16*b* which are mounted to the bottom (floor) 11 of the elevator car 6 and which are configured for monitoring an area of the hoistway 4 below the elevator car 6.

Further pairs of sensors 15*a*, 15*b* may be mounted stationary within the hoistway 4, e.g. in a lower portion (pit) 13 or at the upper end of the hoistway 4.

The sensors 14*a*, 14*b*, 15*a*, 15*b*, 16*a*, 16*b* of each pair are arranged in a configuration in which the fields of view of both sensors 14*a*, 14*b*, 15*a*, 15*b*, 16*a*, 16*b* of each pair at least partly intersect, i.e. for each sensor pair there exists an area within the hoistway which is monitored by both sensors 14*a*, 14*b*, 15*a*, 15*b*, 16*a*, 16*b* of said pair.

Optional lighting devices 19, 20, 21 may be provided at the top 9 and/or bottom 11 of the elevator car 6 and/or within the hoistway 4 for illuminating the hoistway 4. Such an illumination of the hoistway 4 facilitates the detection of persons or items within the hoistway 4.

The sensors 14*a*, 14*b*, 15*a*, 15*b*, 16*a*, 16*b* may be cameras operating in the visible range of light and/or in the infrared range. The frequency of the emission of the lighting devices 19, 20, 21 is adapted to the operating range of the sensors 14*a*, 14*b*, 15*a*, 15*b*, 16*a*, 16*b*. Additionally or alternatively the sensors 14*a*, 14*b*, 15*a*, 15*b*, 16*a*, 16*b* may operate on the basis of ultrasonic sound. Additionally or alternatively, the sensors 14*a*, 14*b*, 15*a*, 15*b*, 16*a*, 16*b* may be infrared sensors or infrared cameras configured to detect thermal radiation emitted by structures in the hoistway or by persons in the hoistway. In such case, no lighting devices will be required.

The sensors 14*a*, 14*b*, 15*a*, 15*b*, 16*a*, 16*b* are connected with an evaluation unit 24 by means of at least one signal line 22 or by at least one wireless connection (not shown).

The evaluation unit 24 is configured for evaluating the signals provided by the sensors 14*a*, 14*b*, 15*a*, 15*b*, 16*a*, 16*b* in order to reliably detect persons or items which are present in the hoistway 4 outside the elevator car 6, and for providing a detection signal to the elevator control unit 26 in case the presence of a person or item within the hoistway 4 is detected.

The evaluation unit 24 in particular comprises a transformation unit 24*a*, a comparison unit 24*b*, and a detection unit 24*c*. The transformation unit 24*a* is configured for transforming the monitoring signals provided by at least one of the sensors and producing transformed signals corresponding to a common direction of vision. As a result of said transformation(s), the transformed signals of both sensors 14*a*, 14*b*, 15*a*, 15*b*, 16*a*, 16*b* of each sensor pair are identical, or match each other, if both sensors operate correctly. Thus, comparing the transformed signals allows to determine whether the sensors 14*a*, 14*b*, 15*a*, 15*b*, 16*a*, 16*b* operate correctly.

The comparison unit 24*b* is configured for comparing the at least two transformed signals. A difference between the at least two transformed signals, which exceeds a predetermined threshold, indicates a malfunction of at least one of the sensors 14*a*, 14*b*, 15*a*, 15*b*, 16*a*, 16*b* and the comparison unit 24*b* is configured for generating a failure signal in this case.

The detection unit 24*c* is configured for detecting a person or undesired item in at least one of the two transformed signals and for generating an alarm signal if a person or undesired item is detected. The transformation unit 24*a*, the comparison unit 24*b*, and the detection unit 24*c* represent functional units, which not necessary need to be implemented in hardware by three individual units. Instead, a single hardware, e.g. a microprocessor programmed to carry out appropriate programs, may provide the functionalities of any of these three units. However, in order to fulfill the enhanced safety requirements of elevator control, special care is to be taken when implementing the units 24*a*, 24*b*, 24*c* in order to reduce the risk of degenerating the safety of the elevator system due to malfunction and breakdown of one of the units 24*a*, 24*b*, 24*c*.

The evaluation unit 24 may further comprise a storage unit 28 for storing previously recorded sensor signals.

Figure 2:
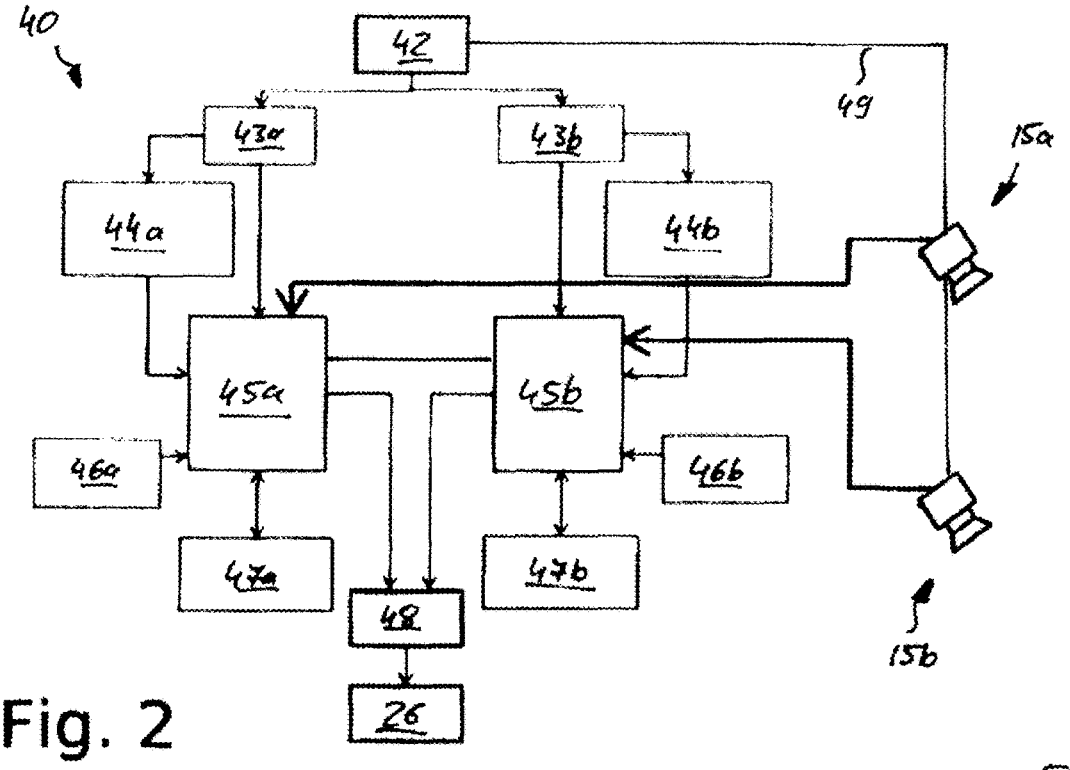
FIG. 2 depicts a block diagram of an evaluation unit of an elevator safety system according to a first exemplary embodiment.

FIG. 2 shows a first embodiment of an evaluation circuit 40 which may be employed in an evaluation unit 24 as it has been described before.

The evaluation circuit 40 comprises two separate voltage regulators 43*a*, 43*b*. Both voltage regulators 43*a*, 43*b* are electrically connected to a common power supply 42 providing the necessary electrical power for operating the evaluation circuit 40. The sensors 15*a*, 15*b* may be supplied with power from the power supply 42 via a power supply line 49. Alternatively, the sensors 15*a*, 15*b* may be supplied with power from an alternative power supply, which is not shown in the figures.

An over/under voltage detection unit 44*a*, 44*b* is assigned to each voltage regulator 43*a*, 43*b*, respectively. Each over/under voltage detection unit 44*a*, 44*b* monitors its assigned voltage regulator 43*a*, 43*b*.

Each voltage regulator 43*a*, 43*b* supplies power to a respectively assigned microprocessor 45*a*, 45*b*. Each microprocessor 45*a*, 45*b* is functionally connected with one of the sensors 15*a*, 15*b* for receiving and processing a sensor signal provided by said sensor 15*a*, 15*b*, respectively.

The two microprocessors 45*a*, 45*b* are also connected to each other in order to allow the exchange of data between the two microprocessors 45*a*, 45*b*.

Each microprocessor 45*a*, 45*b* is provided with an associated temperature sensor 46*a*, 46*b* and a watchdog 47*a*, 47*b* which are respectively configured for monitoring the operation of the associated microprocessor 45*a*, 45*b*.

The two microprocessors 45*a*, 45*b* deliver their output signals to a common logic circuit 48, which is configured for combining the output signals provided by the two microprocessors 45*a*, 45*b* and for delivering a common evaluation signal to the elevator control unit 26.

A failure of one of the microprocessors 45*a*, 45*b* is detected by the other microprocessor 45*a*, 45*b* and/or the common logic circuit 48. The common logic circuit 4 then will deliver a failure signal to the elevator control unit 26 as it has been described before.

Figure 3:
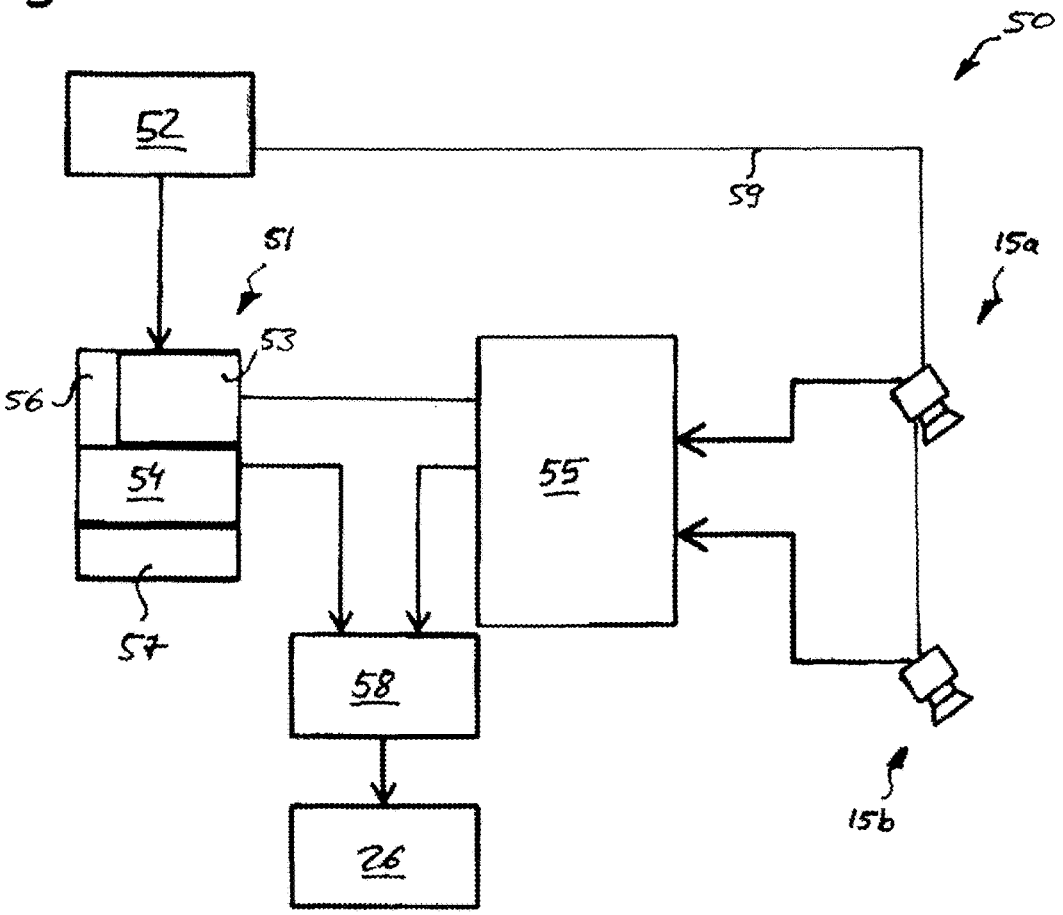
FIG. 3 depicts a block diagram of an evaluation unit of an elevator safety system according to a second exemplary embodiment.

FIG. 3 illustrates a second embodiment of an evaluation circuit 50 using a certified safety microprocessor 55 comprising at least two cores, i.e. a multiple (e.g. dual) core safety microprocessor 55.

Said multiple core safety microprocessor 55 is configured for receiving and processing the signals of at least two sensors 15*a*, 15*b* in parallel. The multiple core safety microprocessor 55 is further provided with appropriate internal means for monitoring the proper operation of its multiple cores.

In consequence, the evaluation circuit 50 according to the second embodiment only needs a single voltage regulator 53, a single over/under voltage detection unit 54, a single temperature sensor 56 and a single watchdog 57, respectively, which may be integrated in a single companion chip 51 which is provided next to the safety microprocessor 55 and supplied with electrical power from a power supply 52. The watchdog 57 included in the companion chip 51 provides for reciprocal monitoring of the individual cores of the multiple core safety microprocessor 55 and delivers a corresponding integrity fault signal. The power supply 52 may further supply power to the sensors 15*a*, 15*b* via a power supply line 59. Alternatively, the sensors 15*a*, 15*b* may be supplied with power from an alternative power supply, which is not shown in the figures.

Both, the safety microprocessor 55 and the companion chip 51 deliver their output signals to a common logic circuit 58 which is configured for combining the signals and delivering a combined evaluation signal to the elevator control unit 26.

Thus, FIGS. 2 and 3 respectively illustrate an example of a safety related microprocessor circuit 40, 50. The microprocessor circuits 40, 50 according to both examples are capable to perform the same functionalities based on the signals provided by the at least two sensors 15*a*, 15*b*.

Figure 4:
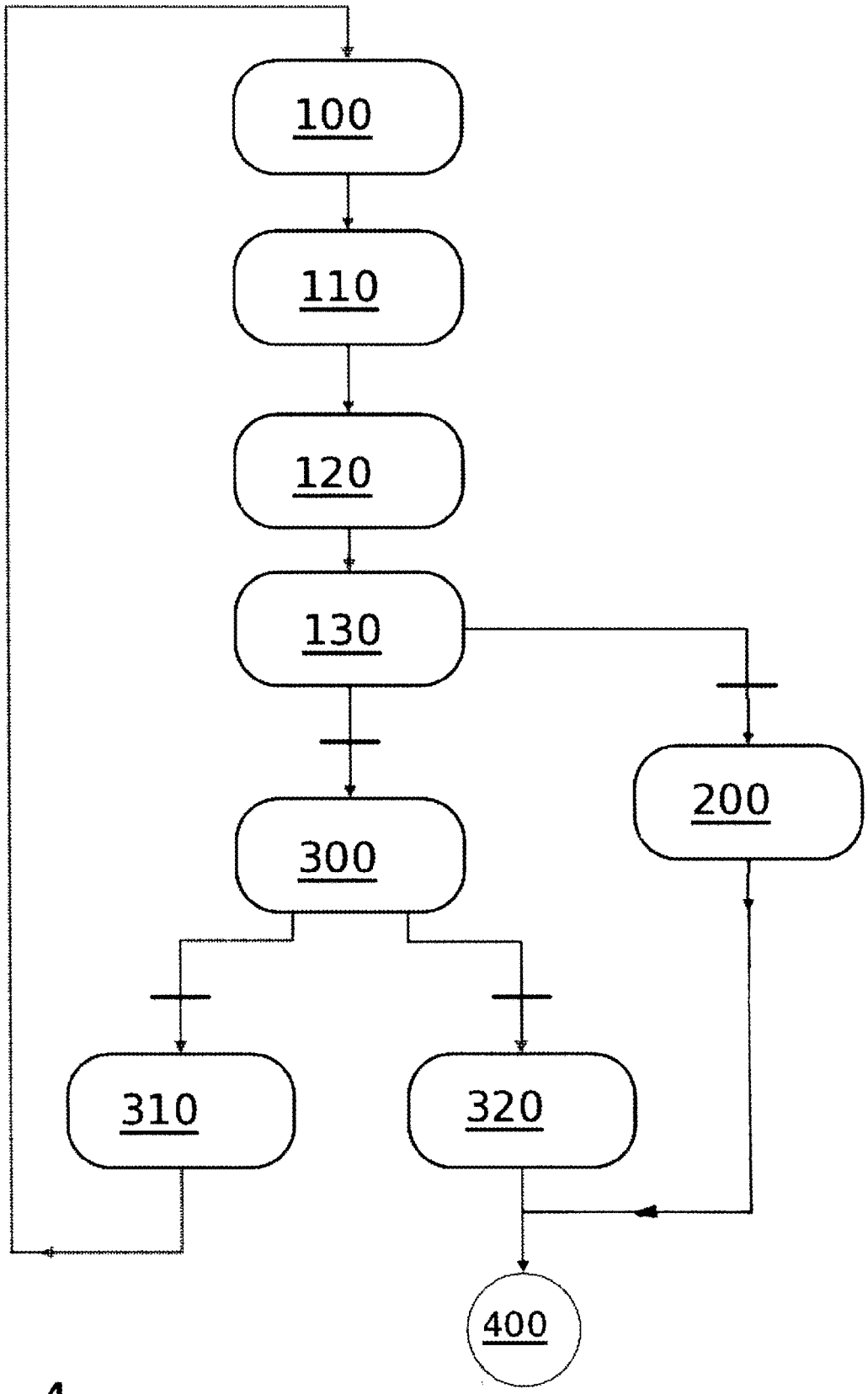
FIG. 4 is a flow diagram illustrating a method of controlling an elevator system according to an exemplary embodiment.

The operation of the elevator access control system according to an exemplary embodiment of the invention is described in the following with reference to FIG. 4 for a single pair of sensors 14*a*, 14*b*, 15*a*, 15*b*, 16*a*, 16*b*.

The skilled person, however, will understand that the same procedure may be carried out for each pair of sensors 14*a*, 14*b*, 15*a*, 15*b*, 16*a*, 16*b* and that instead of each pair of sensors 14*a*, 14*b*, 15*a*, 15*b*, 16*a*, 16*b* a group of three or more sensors 14*a*, 14*b*, 15*a*, 15*b*, 16*a*, 16*b* may be used.

In a first step 100 each sensor 14*a*, 14*b*, 15*a*, 15*b*, 16*a*, 16*b* monitors the respectively assigned area of the hoistway 4 and generates an associated monitoring signal. In a second step 110 the monitoring signals generated by the sensors 14*a*, 14*b*, 15*a*, 15*b*, 16*a*, 16*b* are delivered to the evaluation unit 24 (see FIG. 1), in particular to the transformation unit 24*a* which is part of the evaluation unit 24. The transformation unit 24*a* transforms at least one of the monitoring signals provided by at least one of the sensors 14*a*, 14*b*, 15*a*,

15*b*, 16*a*, 16*b* (step 120), thereby producing a transformed signal so that all sensor signals output by the transformation unit 24*a* represent a common direction of vision. This signal transformation in particular may include virtually transforming including translating and/or rotating the position of at least one of the sensors 14*a*, 14*b*, 15*a*, 15*b*, 16*a*, 16*b* by means of electronic signal transformation or digital signal processing.

The transformation unit 24*a* may transform both monitoring signals to transformed signals corresponding to a common direction of vision. Alternatively, the transformation unit 24*a* may transform only one of the monitoring signals in order to correspond to the direction of vision of the other monitoring signal. In this configuration, the second (other) monitoring signal is not modified. As "transformations" also include the identity transformation, in the following all signals being provided by the transformation unit 24*a* are referred to as "transformed signals".

As a result of said transformation(s), the transformed signals of both sensors 14*a*, 14*b*, 15*a*, 15*b*, 16*a*, 16*b* of each sensor pair are identical if both sensors operate correctly.

This is checked in step 130 by comparing the transformed signals. This check includes calculating the difference between the two transformed signals. In case the difference between the two transformed signals exceeds a predetermined threshold, a malfunction of at least one of the sensors 14*a*, 14*b*, 15*a*, 15*b*, 16*a*, 16*b* is detected and a failure signal is generated (step 200).

In case the difference between the two transformed signals does not exceed the predetermined threshold, a person detection algorithm is applied to at least one of the transformed signals (step 300). Said person detection algorithm is configured for detecting a person and/or an undesired item in the signal, i.e. a person or item being present within the hoistway 4 above or below the elevator car 6.

As the difference between the at least two transformed signals is below the predetermined threshold, it usually is sufficient to apply the person detection algorithm to only one of the transformed signals. However, the reliability may be enhanced even further by applying the person detection algorithm to both transformed signals.

In case a person or an undesired item is detected in at least one of the transformed signals, a detection signal is generated (step 320).

In case neither a failure signal nor a detection signal is generated, normal operation of the elevator system continues (step 310).

In case, however, at least one of a failure signal and a detection signal is generated, operation of the elevator system will switch to an emergency mode (step 400) which includes stopping any further movement of the elevator car 6. In order to avoid passengers from being trapped within the elevator car 6, the operation in the emergency mode may include moving the elevator car 6 to a predetermined (safe) landing 8 and opening the doors 10, 12 of the elevator car 6 and the associated landing 8 in order to allow passengers to leave the elevator car 6.

The predetermined landing 8 is a landing 8 which is considered as being appropriate for this kind of emergency mode. It may be a specific landing 8, e.g. the lobby, or the next landing 8 in the current travel direction, or the nearest landing 8 in a certain travel direction, e.g. only in the upward direction.

In an exemplary embodiment, the elevator car 6 will not be moved to the topmost or lowest landing 8, in order to avoid persons or items residing in these areas of the hoistway 6 from being hit or squeezed by the elevator car 6. In case, however, a person or item is detected only in the lower portion (pit) 13 of the hoistway 4, the elevator car 6 may be moved to the upper end of the hoistway 4 and vice-versa.

In case persons and/or items are detected both above and below the elevator car 6, the elevator control system may cause the elevator car 6 to move to a predetermined landing 8, as it has been described before. Alternatively it may stop any further movement of the elevator car 6. This in particular may depend on the configuration of the elevator system 2 and/or on the position(s) of the detected person(s) and/or item(s).

Normal operation of the elevator system will continue only after the hoistway 4 has been checked for and cleared from persons or undesired items.

A number of optional features are set out in the following. These features may be realized in particular embodiments, alone or in combination with any of the other features.

In an embodiment, the at least two sensors may be optical sensors, in particular cameras, which are configured for capturing optical pictures of the interior of the hoistway. The cameras may operate in the visible range of light. The cameras may be b/w-cameras or cameras capturing colored pictures. Optical cameras provide inexpensive and reliable sensors.

The cameras in particular may be 3D-cameras, which are configured for capturing 3-dimensional pictures. 3-dimensional pictures allow for a very reliable identification of persons and unwanted items which are present within the hoistway.

Alternatively or additionally the sensors may operate in the range of infrared light or on the basis of ultrasonic sound. Sensors using the infrared range of light and/or ultrasonic sound may enhance the reliability of the detection. Particularly, infrared sensors or cameras may be used which are configured to detect thermal radiation emitted from hoistway structures and/or persons in the hoistway. In such configuration, no additional lighting devices will be required, since the infrared sensors or cameras will detect any thermal radiation emitted from hoistway structures or objects within the hoistway, particularly from persons in the hoistway.

The system may comprise at least one additional source of light and/or (ultrasonic) sound which is configured to provide the necessary light and/or (ultrasonic) sound which is to be reflected by a person and/or an item for being detected.

In an embodiment, at least one of the sensors may be configured for being attached to the hoistway. Stationary attaching the sensor(s) to the walls of the hoistway results in an easy and inexpensive installation. The sensor(s) in particular may be installed in or close to areas of the hoistway which are very likely to be entered by persons such as the top or the bottom (pit) of the hoistway.

In an embodiment, at least one of the sensors may be configured for being attached to the elevator car, in particular to the top or to the bottom of the elevator car. Sensors attached to the elevator car are very effective in monitoring the areas of the hoistway close to the elevator car in order to avoid persons or items being hit or squeezed by the moving elevator car.

In an embodiment, the transformation unit, the comparison unit and the detection unit may be integrated with each other forming a safety unit. This provides a compact safety unit and malfunction resulting from erroneous connections between the units may be avoided.

In an embodiment, at least one of the transformation unit, the comparison unit and the detection unit may be provided redundantly, in particular by at least two CPUs or by a multiple (e.g. dual) CPU comprising multiple (e.g. two)

processors. This enhances the reliability of the safety system. In an embodiment, all units are provided redundantly.

In an embodiment, the detection unit may be configured for running a self-learning algorithm comprising an initialization/learning mode and a monitoring mode.

In the initialization/learning mode, the detection unit records and stores sensor signals which are detected in the hoistway in a situation in which no persons or unwanted items are present within the hoistway. In the monitoring mode, signals, which are currently detected in the hoistway are compared with the previously recorded signals to identify differences indicating the presence of persons or unwanted items within the hoistway. In order to store the previously recorded signals, the detection unit may comprise a storage unit which is configured for storing the signals which have been recorded in the course of the initialization/learning mode with no persons or unwanted items being present within the hoistway.

Additionally or alternatively, the detection unit may be configured for detecting patterns in the transformed signals corresponding to movement in the hoistway, which do not result from the movement of the elevator car with respect to the stationary hoistway structure. Movement in the hoistway may indicate the presence of a person in the hoistway.

In an embodiment the control unit may be configured for stopping movement of the elevator car as soon as a detection signal and/or a failure signal has been generated. This enhances the safety of the elevator system as any collision of the elevator car with a person or item being present within the hoistway is reliably prevented.

In an embodiment the control unit may be configured for moving the elevator car to a designated landing and for opening the doors of the elevator car and the landing doors of the designated landing in order to allow passengers to leave the elevator car. This avoids passengers from being trapped within the elevator car in case a malfunction or presence of a person or item in the hoistway is detected.

In this embodiment, the safety may be enhanced even further by not moving the elevator car to the topmost or lowest landing. In case, however, people or items are detected only in the lower portion (pit) of the hoistway, the elevator car may be moved to the upper end of the hoistway and vice-versa.

While the invention has been described with reference to exemplary embodiments, it will be understood by those skilled in the art that various changes may be made and equivalents may be substituted for elements thereof without departing from the scope of the invention. In addition many modifications may be made to adopt a particular situation or material to the teachings of the invention without departing from the essential scope thereof. Therefore, it is intended that the invention not be limited to the particular embodiment disclosed, but that the invention include all embodiments falling within the scope of the claims.

REFERENCES

2 elevator system
3 tension member
4 hoistway
5 drive
6 elevator car
8 landing
9 ceiling of the elevator car
10 landing door
11 floor of the elevator car
12 elevator car door
13 bottom (pit) of the hoistway
14*a*, 14*b* sensors on top of the elevator car
15*a*, 15*b* sensors at the bottom (pit) of the hoistway
16*a*, 16*b* sensors below of the elevator car
18 display and control unit
19, 20, 21 lighting device
22 signal line
24 evaluation unit
26 elevator control unit
28 storage unit
30 security center
40 evaluation circuit (first embodiment)
42 power supply (first embodiment)
43*a*, 43*b* voltage regulator (first embodiment)
44*a*, 44*b* over/under voltage detection unit (first embodiment)
45*a*, 45*b* microprocessor (first embodiment)
46*a*, 46*b* temperature sensor (first embodiment)
47*a*, 47*b* watchdog (first embodiment)
48 common logic circuit (first embodiment)
49 power supply line (first embodiment)
50 evaluation circuit (second embodiment)
51 companion chip (second embodiment)
52 power supply (second embodiment)
53 voltage regulator (second embodiment)
54 over/under voltage detection unit (second embodiment)
55 safety microprocessor (second embodiment)
56 temperature sensor (second embodiment)
57 watchdog (second embodiment)
58 common logic circuit (second embodiment)
59 power supply line (second embodiment)

The invention claimed is:

1. Elevator safety system comprising:

at least two sensors, each of the sensors being configured for monitoring at least a portion of a hoistway of an elevator system and providing monitoring signals;

a transformation unit which is configured for transforming the monitoring signals provided by at least one of the sensors and producing transformed signals corresponding to a common direction of vision;

a comparison unit which is configured for comparing the at least two transformed signals and for generating a failure signal if a difference between the at least two transformed signals exceeds a predetermined threshold; and a detection unit, which is configured for detecting a person or undesired item in at least one of the two transformed signals and for generating an alarm signal if a person or undesired item is detected.

2. Elevator safety system according to claim 1 wherein the at least two sensors are optical sensors, in particular cameras.

3. Elevator safety system according to claim 2 wherein the at least two sensors are 3D-cameras.

4. Elevator safety system according to claim 1, wherein at least one of the sensors is configured to be attached to the hoistway.

5. Elevator safety system according to claim 1, wherein at least one of the sensors is configured to be attached to an elevator car of the elevator system.

6. Elevator safety system according to claim 1, wherein the transformation unit, the comparison unit and the detection unit are integrated forming a safety unit.

7. Elevator safety system according to claim 1, wherein at least one of the transformation unit, the comparison unit and the detection unit is configured redundantly, in particular by at least two microprocessors or a multiple core safety microprocessor.

8. Elevator safety system according to claim 1, wherein the detection unit is configured for performing a self-learning algorithm.

9. Elevator safety system according to claim 1, wherein the detection unit comprises a storage unit for storing monitoring and/or transformed signals, in particular signals in which no person and undesired item are present.

10. Elevator system comprising:

at least one elevator car which is configured to travel along a hoistway;

an elevator safety system according to claim 1;

an elevator control unit, which is configured for controlling movement of the at least one elevator car and for receiving signals from the elevator safety system.

11. Elevator system according to claim 10, wherein the control unit is configured to stop movement of the elevator car if a failure signal or an alarm signal is received from the elevator safety system, and/or wherein the control unit is configured to move the elevator car to the next landing and to stop any further operation of the elevator system if a failure signal or an alarm signal is received from the elevator safety system.

12. Elevator system according to claim 9, wherein the at least two sensors of the elevator safety system are mounted to the top and/or to the bottom of the elevator car.

13. Elevator system according to claim 9, wherein the at least two sensors of the elevator safety system are mounted to the hoistway, in particular at an upper and/or lower end of the hoistway.

14. Method of operating an elevator system comprising at least one elevator car which is configured to travel along a hoistway, wherein the method includes:

monitoring at least a portion of the hoistway with at least two sensors and providing monitoring signals;

transforming the monitoring signals provided by the at least two sensors to transformed signals corresponding to the same direction of vision;

comparing the at least two transformed signals and generating a failure signal if a difference between the at least two transformed signals is detected;

checking at least one of the two transformed signals for persons or undesired items and generating an alarm signal if at least one person or undesired item is detected; and stopping operation of the elevator system in case a failure signal and/or an alarm signal is generated.

15. Method according to claim 14 wherein the method includes moving the elevator car to the next landing before any operation of the elevator system is stopped.

* * * * *